United States Patent [19]

Uchikawa et al.

[11] Patent Number: 4,487,560

[45] Date of Patent: Dec. 11, 1984

[54] SCROLL FLUID COMPRESSOR WITH SURFACE FINISHED FLAT PLATES ENGAGING THE WRAPS

[75] Inventors: Naoshi Uchikawa; Mineo Takahashi; Hiromu Watanabe, all of Shimizu, Japan

[73] Assignee: Hitachi, Ltd., Tokyo, Japan

[21] Appl. No.: 410,953

[22] Filed: Aug. 24, 1982

[30] Foreign Application Priority Data

Sep. 22, 1981 [JP] Japan ..... 56-148831

[51] Int. Cl.[3] ..... F04C 18/02; F04C 29/00

[52] U.S. Cl. ..... 418/55; 418/178; 418/179

[58] Field of Search ..... 418/55, 178, 179

[56] References Cited

U.S. PATENT DOCUMENTS

| | | | |
|---|---|---|---|
| 3,008,425 | 11/1961 | Chambers | 418/179 |
| 3,313,239 | 4/1967 | Brunson et al. | 418/179 |
| 3,361,074 | 1/1968 | Eckerle | 418/178 |
| 3,680,990 | 8/1972 | Pettibone et al. | 418/178 |
| 3,884,599 | 5/1975 | Young et al. | 418/55 |
| 3,887,310 | 6/1975 | Gerber | 418/178 |
| 3,986,799 | 10/1976 | McCullough | 418/55 |
| 3,994,635 | 11/1976 | McCullough | 418/55 |
| 4,047,855 | 9/1977 | Goloff et al. | 418/178 |
| 4,216,661 | 8/1980 | Tojo et al. | 418/55 |

FOREIGN PATENT DOCUMENTS

| | | | |
|---|---|---|---|
| 55-35155 | 3/1980 | Japan | 418/155 |
| 55-72680 | 5/1980 | Japan | 418/55 |

*Primary Examiner*—John J. Vrablik

*Attorney, Agent, or Firm*—Antonelli, Terry & Wands

[57] ABSTRACT

In a scroll fluid compressor including orbiting and stationary scroll members having end plates and wraps in vortical form in upstanding positions on the end plates meshing with each other to define therebetween spaces for compressing a fluid introduced through an inlet line and discharging the compressed fluid through an outlet line, flat plates in vortical form having surface finishes of higher precision than the end plates are placed in valleys between the outer wraps and the inner wraps of the scroll members to enable the wrap of the orbiting scroll member to move in orbiting movement while having the forward ends of the wraps in sliding contact with the surfaces of the flat plates in vortical form. Stepped portions may be formed on the bottoms of the valleys to hold the flat plates in vortical form in place, or space may be provided between the flat plates in vortical form and the bottoms of the valleys to be filled with a filler material from outside through ducts formed in the end plates, to bond the flat plates in vortical form to the end plates to enable the forward ends of the wraps to be maintained in uniform contact with the flat plates in vortical form.

13 Claims, 7 Drawing Figures

SCROLL FLUID COMPRESSOR WITH SURFACE FINISHED FLAT PLATES ENGAGING THE WRAPS

BACKGROUND OF THE INVENTION

This invention relates to scroll fluid apparatus, and, more particularly, to a scroll fluid compressor wherein an improved seal is provided between forward ends of the wraps and end plates of scroll members of the scroll fluid compressor.

A scroll type fluid compressor is disclosed, for example, in U.S. Pat. No. 3,884,599 which comprises an oribiting scroll member and a stationary scroll member. The orbiting scroll member comprises an end plate, and a wrap of the vortical form upstanding on the end plate and having an involute curve or a curve similar thereto, and the stationary scroll member comprises an end plate and a wrap similar in construction to those of the orbiting scroll member and is formed with an outlet port substantially in the center of the end plate, and an inlet port opening at the outer side of the end plate. The orbiting scroll member and the stationary scroll member are brought into contact with each other in such a manner that the wraps of the two members are meshing with each other while being maintained at their forward ends in intimate contact with the surfaces of the opposite end plates. The two scroll members arranged are housed in a housing having an inlet line and an outlet line connected thereto.

An Oldham's ring, which is a rotation-on-its-own-axis preventing member, for the orbiting scroll member is mounted between the orbiting scroll member and the stationary scroll member, and a crankshaft is in engagement with the orbiting scroll member to cause the latter to move in orbiting movement without rotating on its own axis. A fluid is compressed in sealed spaces defined between the two scroll members and the compressed fluid is discharged through the outlet port.

It has been usual practice to machine the side surfaces of the vortical wraps and the end plates of the scroll members of a scroll fluid compressor by a machine tool, such as a numerically controlled milling machine. However, the disadvantage of this method resides in the fact that difficulties are encountered in machining the portions of the end plates which constitute volleys between the wraps to achieve flatness thereof with a high degree of precision. The surface of the machined end plates is rather coarse, making it difficult to provide a satisfactory seal between the forward ends of the wraps and the end plates when the orbiting scroll member moves in orbiting movement in cooperation with the stationary scroll member. The coarse surface of the end plates causes a high friction loss and seizure of the forward ends of the wraps to occur.

More specifically, the method of working on the end plates that has been used has been unable to achieve satisfactory results in providing a smooth sliding surface because the surface obtained has had a coarseness of about 10s (according to Japanese Industrial Standards). Additionally, when the end plates are subjected to surface treatment to increase their hardness, the end plates have tended to suffer deformation and their flatness has been reduced.

To obviate the aforesaid problems, in, for example, U.S. Pat. No. 3,994,635, it has been proposed to prepare the end plate and the vortical wrap separately and work on them independently, and mount the wrap in a groove formed in the end plate after achieving a desired flatness in the surface of the end plate. In, for example, U.S. Pat. No. 3,986,799, scroll fluid compressor is proposed wherein the wrap is firmly secured to the end plate by bolts after being separately prepared and independently worked on.

When the separately prepared vortical wrap and the end plate are independently worked on, means for securing the wrap in the groove formed in the end plate become complex in construction and might cause a reduction in reliability. Bolting of the wrap to the end plate would suffer the disadvantages that the wrap itself might suffer deformation and the working steps would increase in number.

In, for example, Japanese Laid Open Application No. 35155/80, still another type of scroll fluid compressor is proposed wherein a resilient member is fitted on the bottom of the valley between the wraps of the scroll members having the end plates and the vortical wraps formed integrally. The resilient member comprises a rubber member and a plate spring formed of SK steel, bronze, etc., secured to the surface of the rubber plate. However, problems arise with regard to the resistance of rubber to a refrigerant and the difficulty with which a spring material may be secured to the rubber plate.

SUMMARY OF THE INVENTION

An object of this invention is to provide a scroll fluid apparatus wherein an improved seal is provided by the forward ends of the wraps.

Another object is to provide a scroll fluid apparatus in which the forward ends of the wraps in contact with the end plates have a reduced loss of friction.

To accomplish the aforesaid objects, in accordance with the present invention flat plates in vortical form of higher precision surface finishes than the end plates are fitted in the valleys between the inner wraps, and the outer wraps respectively, of orbiting and stationary scroll members in which the wraps in vortical form are located in upstanding position on the respective end plates. In this construction, the orbiting scroll member moves in orbiting movement with respect to the stationary scroll member while the wrap of one scroll member has its forward end being maintained in contact with the flat plate in vortical form on the surface of the end plate of the other scroll member.

In accordance with further features of the present invention, a hollow space is defined between each of the flat plates in vortical form and the surface of the end plate in the valley in which the flat plate is fitted, and filler material is injected into each space from outside through passages to bond the flat plates in vortical form to the surface of the end plates.

DESCRIPTION OF THE PREFERRED EMBODIMENTS

Figure 1:
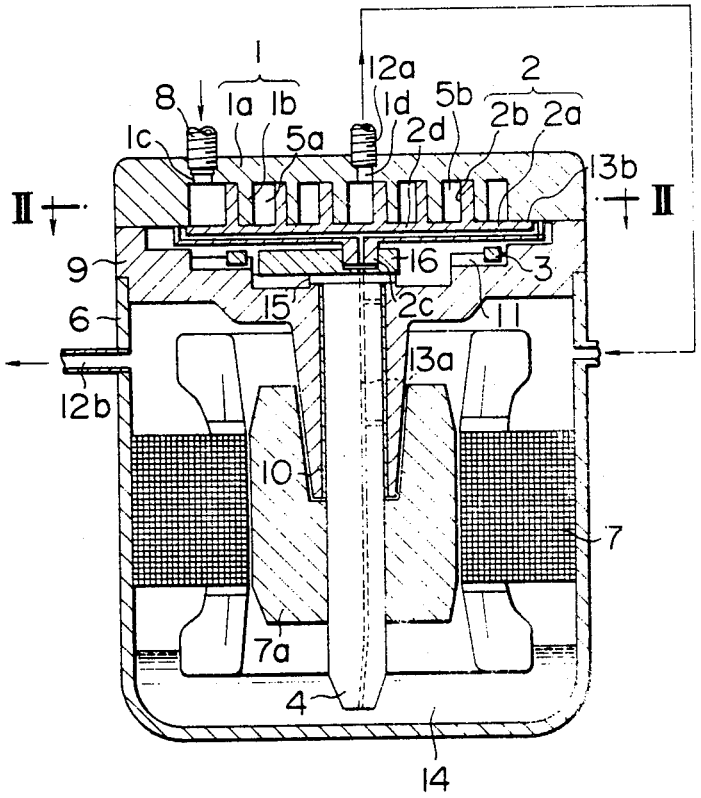
FIG. 1 is a cross-sectional view of a scroll fluid compressor in accordance with one embodiment of the present invention.

Referring now to the drawings wherein like reference numerals are used throughout the various views to designate like parts and, more particularly, to FIG. 1, according to this figure, a scroll fluid compressor includes a stationary scroll member 1 comprising an end plate 1*a* and a wrap 1*b* in vortical form integral with the end plate 1*a* is in engagement with an orbiting scroll member 2 formed with an end plate 2*a* and a wrap 2*b* of substantially the same construction as the stationary scroll member 1 in such a manner that the wraps 1*b* and 2*b* are in mesh with each other. A rotation-on-its-own-axis preventing member 3, generally referred to as an Oldham's ring, is mounted between a frame 9 secured to the stationary scroll member 1 and the orbiting scroll member 2. The orbiting scroll member 2 includes a shaft portion 2*c* slidably fitted in a recess in a balance weight 16 for orbiting movement. A crankshaft 4 is secured to a rotor 7*a* of a motor 7 and rotatably supported by the frame 9 through a bearing 10. The crankshaft includes a lower end portion immersed in oil in an oil sump 14 at the bottom of a sealed vessel 6, and an upper end portion composed of a stopper 15 and the balance weight 16. Compression chambers 5*a* and 5*b* are defined between the end plates 1*a* and 2*a* of the two scroll members 1 and 2. An inlet line 8 is connected to an inlet port 1*c* formed in the stationary scroll member 1 and communicating with the compression chambers 5*a* and 5*b* serving as suction chambers. An outlet line 12 is connected to a port 1*d* formed in the end plate 1*a* of the stationary scroll member 1 and opens at its forward end in a motor chamber in the sealed vessel 6. A line 12*b* connects the sealed vessel 6 to equipment of high pressure, such as a condenser. An oil passageway 13*a* extends through the crankshaft 4 to supply oil to the bearing 10 and an oil passageway 13*b* in the orbiting scroll member 2.

Figure 2:
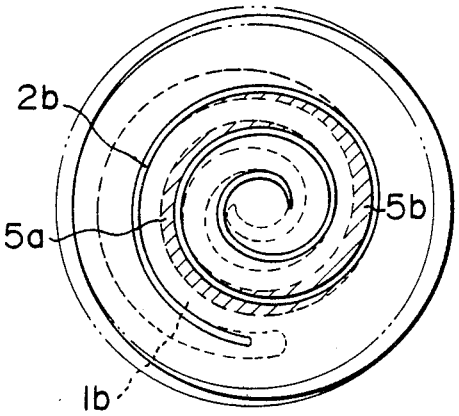
FIG. 2 is a cross sectional view taken along the line II—II in FIG. 1.
Figure 3:
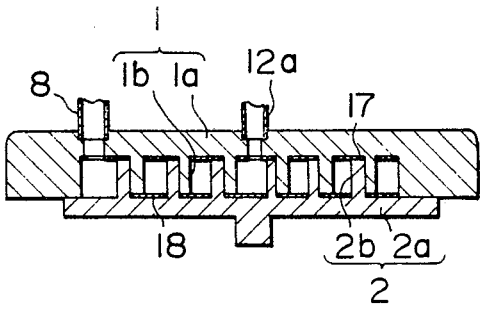
FIG. 3 is a cross sectional view, on an enlarged scale, of the orbiting scroll member and the stationary scroll member.

Referring to FIG. 2, as the orbiting scroll member 2 is moved in orbiting movement in a clockwise direction by the crankshaft 4, the compression chamber 5 and 5*b* located in the outermost position which are hatched move toward the center of the two scroll members 1 and 2 while their volumes are successively reduced until the compressed gas is discharged through the port 1*d*. In the scroll fluid compressor of the aforesaid construction and operation, a force tending to move the stationary scroll member 1 and the orbiting scroll member 2 away from each other acts on the two scroll members 1 and 2 due to the pressure of the compressed gas in the compression chambers 5*a* and 5*b*. If no means are provided to counter this force, the two scroll members 1 and 2 would be separated from each other and no normal compression action could be performed. To this end, means are generally provided to apply a gas pressure or a spring pressure to the back of the orbiting scroll member 2 so as to exert an axially biasing force greater than the force tending to move the orbiting scroll member 2 away from the stationary scroll member 1.

Figure 4:
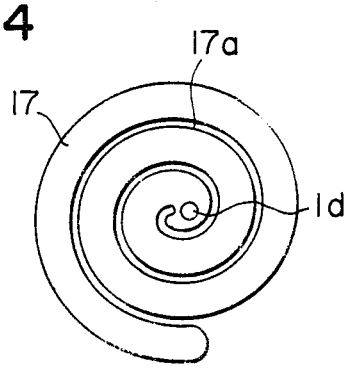
FIG. 4 is a plan view of the flat plate in vortical form.

According to the invention, flat plates 17 and 18, in vortical form of more precise surface finishes than the end plates 1*a* and 2*b*, are fitted in a valley on the end plate between the inner wraps and the outer wraps, and the wraps 1*b* and 2*b* are brought into sliding contact at their forward ends with the surfaces of high precision finishes of the flat plates 17 and 18 in vortical form in the compression chambers defined between the two scroll members 1 and 2. FIG. 4 shows a flat plate 17 in vortical form formed by punching a sheet material to form a curved slit 17*a* of the same shape as the wraps 1*b* and 2*b*. The flat plate 17 has one surface or both surfaces thereof machined to achieve high surface precision finishes, so that improved sealing effects can be achieved by the forward ends of the wraps in contact with the flat plates in vortical form and a loss of friction that the forward ends of the wraps might otherwise suffer when moving in sliding contact with the end plates can be minimized. Fitting of the flat plate 17 in vortical form in the valley between the wraps is facilitated if the flat plate 17 has a width slightly smaller than the width of the valley.

Figure 5:
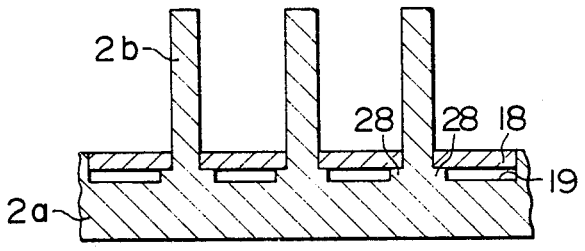
FIG. 5 is a fragmentary view, on an enlarged scale, of the orbiting scroll member in accordance with another embodiment of the invention.

As shown in FIG. 5, a stepped portion 28 is formed in a corner defined by a side wall of the wrap and the end plate, and a flat plate 18 of substantially the same shape as the flat plate 17 shown in FIG. 4 is placed on the stepped portions 28. When this construction is used, the portion of the end plate corresponding to the valley 19 need not be machined, enabling the number of working steps to be reduced.

Figure 6:
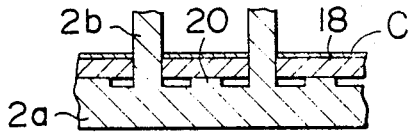
FIG. 6 is a fragmentary view, on an enlarged scale, of the orbiting scroll member in accordance with still another embodiment of the invention.
Figure 7:
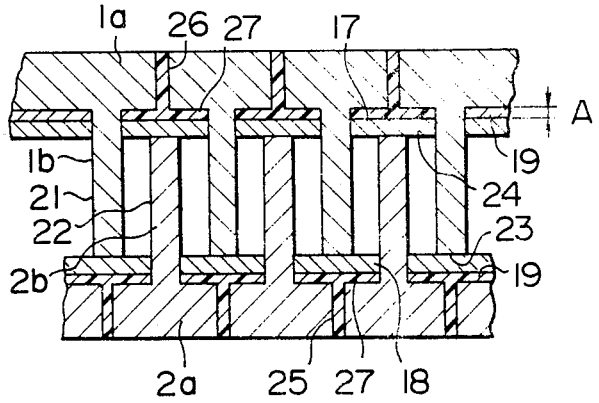
FIG. 7 is a fragmentary sectional view, on an enlarged scale, of the orbiting scroll member and the stationary scroll member in accordance with a further embodiment of the invention.

In FIG. 6, a stepped portion 20 is formed substantially in the center of the valley between the wraps on the end plate, and the flat plate 18 is placed on the stepped portions 20, with the same results as achieved by the embodiment with the stepped portions 28. In FIG. 7, shows a further embodiment in which the intimacy with which the forward ends of the wraps are kept in contact with the end plates can be improved without requiring an increase in the degree of precision finishes. The valleys 19 of the stationary and orbiting scroll members are not machined and side surfaces 21 and 22 and forward ends 23 and 24 alone of the wraps 1*b* and 2*b* are subjected to precise machining. The flat plates 17 and 18 having their surface machined are fitted between the wraps 1*b* and 2*b* in such a manner that a small gap A is formed between the surfaces of the end plates and the flat plates 17 and 18. The end plates 1*a* and 2*b* of the stationary and orbiting scroll members 1 and 2 are formed with ducts 25 and 26 of a large number opening at the bottom of the valleys 19. After the parts are assembled, a filler material 27, such as rubber or resin in fluid condition, is injected through the ducts 25 and 26 under suitable pressure into spaces between the vortical flat plates 17 and 18 and the bottom of the valley 19 so that the flat plates 17 and 18 can be secured to the bottom of the valley 19 while the forward ends 23 and 24 of the wraps 1*b* and 2*b* are in intimate contact with the flat plates 17 and 18. This eliminates the gap that might otherwise be present between the wrap forward ends 23 and 24 and the flat plates 17 and 18, to enable the wraps to move in sliding motion on the surfaces of the flat plates 17 and 18 of high precision finishes to thereby greatly increase the sealing characteristics of the wraps 1*b* and 2*b* and at the same time minimize a loss of friction. The bottom of the valley 19 need not be machined and no trouble occurs even if it is subjected to no treatment, thereby enabling the working steps to be reduced in number. Additionally, the absence of an axial gap between the wrap forward ends and the bottom of the valley minimizes a loss of compressed gas due to leaking. Since the end plates of the scroll members 1, 2 need no increase in the degree of precision with which they are finished, the bottom of the valley on the end plates does not need to be subjected to any treatment, thereby contributing to improving productivity. Meanwhile, it is possible to improve the slidability of contact surfaces by varying the material of the wraps and the material of the surface at which the wraps are brought into sliding contact at their forward ends. This is conducive to prevention of wear and seizure from occurring.

When different materials are used for the wraps 1*b* and 2*b* and the flat plates 17 and 18 in vortical form, the material for the vortical flat plates may be softer than that for the wraps. In this case, the wraps may be formed of cast iron and the vortical flat plate may be formed of brass, copper or aluminum including an aluminum alloy. The material for the vortical flat plates may be harder than that for the wraps. In this case, the wraps may be formed of aluminum, and the vortical flat plates may be formed of sheet steel. To provide a soft surface, as shown in FIG. 6, the vortical flat plates may be coated with a soft coating material C. The vortical flat plates of surface finishes of higher precision than the end plates of the scroll members have only to have enough rigidity to maintain their flatness and do not need to have a greater thickness than is necessary.

From the foregoing description, it will be appreciated that the invention enables, by the aforesaid characteristic features, the wraps to provide an improved seal at their forward ends in contact with the end plates and permits a loss of friction to be minimized.

What is claimed is:

1. A scroll fluid compressor comprising:

an orbiting member including an end plate and a wrap in vortical form integral with said end plate and located in an upstanding position on the end plate;

a stationary scroll member including an end plate and a wrap in vortical form substantially of the same construction as said end plate and said wrap of said orbiting scroll member, said wrap in vortical form being in mesh with said wrap of said orbiting scroll member when the two scroll members are assembled with each other;

a crankshaft having a shaft portion for supporting said orbiting scroll member for orbiting movement, said crankshaft having a balance weight formed integrally therewith;

a frame including a bearing means for journalling said crankshaft and formed so as to enclose said orbiting scroll member on an inner side thereof and bring the same into contact with said stationary scroll member;

means for preventing said orbiting scroll member from rotating on its own axis connecting said frame to said orbiting scroll member;

a rotor of a motor secured to said crankshaft;

a sealed vessel for housing said orbiting scroll member and having secured thereto a stator of said motor in a sealed condition and formed with an oil sump in a lower portion thereof;

oil feeding means located in an end portion of said crankshaft and immersed in said oil sump;

a fluid inlet line and a fluid outlet line communicating with spaces defined between said end plates of said orbiting scroll member and said stationary scroll member;

flat plates in vortical form each fitted in a valley between the outer wraps and the inner wraps of the oribiting scroll member and the stationary scroll member, said flat plates having surface finishes of higher precision than said end plates of said two scroll members, whereby said wrap of said orbiting scroll member can move in orbiting movement while having forward ends of the two scroll members maintained in sliding contact with the surfaces of the flat plates; and stepped portions are formed on a bottom of the valleys so as to stably hold the flat plates in place.

2. A scroll fluid compressor as claimed in claim 1, wherein said flat plates have a width slightly smaller than a width of the valleys between the inner wraps and the outer wraps.

3. A scroll fluid compressor as claimed in claim 1, wherein said stepped portions are locked in corners formed by side walls of the wraps and the end plates.

4. A scroll fluid compressor as claimed in claim 1, wherein said stepped portions are located on the end plates in a central portion thereof between the inner wraps and the outer wraps of the orbiting and stationary scroll members.

5. A scroll fluid compressor as claimed in claim 1, wherein said flat plates are each provided with a coating.

6. A scroll fluid compressor as claimed in claim 1, wherein said flat plates each have a rigidity sufficient to maintain the flatness thereof.

7. A scroll fluid compressor as claimed in claim 1, wherein said flat plates are formed of different materials.

8. A scroll fluid compressor as claimed in claim 7, wherein said flat plates are formed of a softer material than said wraps.

9. A scroll fluid compressor as claimed in claim 8, wherein said wraps are formed of cast iron and said flat plates are formed of brass.

10. A scroll fluid compressor as claimed in claim 8, wherein said wraps are formed of cast iron and said flat plates are formed of copper.

11. A scroll fluid compressor as claimed in claim 7, wherein said wraps are formed of cast iron and said flat plates are formed of aluminum including an aluminum alloy.

12. A scroll fluid compressor as claimed in claim 7, wherein said flat plates are formed of a harder material than said wraps.

13. A scroll fluid compressor as claimed in claim 12, wherein said wraps are formed of aluminum and said flat plates are formed of sheet steel.

* * * * *